US011204048B2

(12) United States Patent
Yuan

(10) Patent No.: US 11,204,048 B2
(45) Date of Patent: Dec. 21, 2021

(54) SYSTEM FOR DAMPING MASS-INDUCED VIBRATION IN MACHINES HAVING HYDRAULICALLY CONTROLLED BOOMS OR ELONGATE MEMBERS

(71) Applicant: EATON INTELLIGENT POWER LIMITED, Dublin (IE)

(72) Inventor: Qinghui Yuan, Edina, MN (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/665,553

(22) Filed: Oct. 28, 2019

(65) Prior Publication Data

US 2020/0124060 A1 Apr. 23, 2020

Related U.S. Application Data

(63) Continuation of application No. PCT/US2018/029401, filed on Apr. 25, 2018.
(Continued)

(51) Int. Cl.
*F15B 21/00* (2006.01)
*F15B 13/02* (2006.01)
(Continued)

(52) U.S. Cl.
CPC ..... *F15B 21/008* (2013.01); *F15B 13/029* (2013.01); *F15B 13/043* (2013.01);
(Continued)

(58) Field of Classification Search
CPC ..... F15B 21/008; F15B 2211/8613; F15B 2211/8616; E02F 9/2207
See application file for complete search history.

(56) References Cited

U.S. PATENT DOCUMENTS 3,917,246 A 11/1975 Gartner et al.
4,621,375 A 11/1986 Simnovec
(Continued)

FOREIGN PATENT DOCUMENTS

CN 10253871 8/2004
CN 1932215 3/2007
(Continued)

OTHER PUBLICATIONS

International Search Report and Written Opinion of the International Searching Authority for International Patent Application No. PCT/US2018/029401 dated Jul. 23, 2018, 18 pages.
(Continued)

*Primary Examiner* — Michael Leslie
(74) *Attorney, Agent, or Firm* — Merchant & Gould P.C.

(57) ABSTRACT

A system for damping mass-induced vibrations in a machine having a long boom or elongate member, the movement of which causes mass-induced vibration in such boom or elongate member. The system comprises multiple pressure sensors operable to measure pressure fluctuations in the hydraulic fluid pressures in the non-load holding and load holding chambers of a hydraulic actuator connected to the boom or elongate member that result from mass-induced vibration, and a processing unit operable to control a first control valve spool in a pressure control mode and a second control valve spool in a flow control mode in order to adjust hydraulic fluid flow to the actuator's load holding chamber to dampen the mass-induced vibration. The system further comprises a control manifold fluidically interposed between the actuator and control valve spools that causes the first and second control valve spools to operate, respectively, in pressure and flow control modes.

22 Claims, 5 Drawing Sheets

Related U.S. Application Data

(60) Provisional application No. 62/532,764, filed on Jul. 14, 2017, provisional application No. 62/491,903, filed on Apr. 28, 2017.

(51) Int. Cl.
*F15B 13/043* (2006.01)
*F15B 20/00* (2006.01)

(52) U.S. Cl.
CPC ..... *F15B 20/007* (2013.01); *F15B 2211/5059* (2013.01); *F15B 2211/50581* (2013.01); *F15B 2211/6058* (2013.01); *F15B 2211/634* (2013.01); *F15B 2211/6355* (2013.01); *F15B 2211/8616* (2013.01)

(56) References Cited

U.S. PATENT DOCUMENTS 4,896,582 A 1/1990 Tordenmalm et al.
5,048,296 A 9/1991 Sunamura et al.
5,191,826 A 3/1993 Brunner
5,230,272 A 7/1993 Schmitz
5,245,826 A 9/1993 Roth et al.
5,571,226 A 11/1996 Kobayashi
5,640,996 A 6/1997 Schlecht et al.
5,699,386 A 12/1997 Measor et al.
5,715,865 A 2/1998 Wilke
5,784,944 A 7/1998 Tozawa et al.
5,832,730 A * 11/1998 Mizui ..... B66C 13/066 60/469
5,996,465 A 12/1999 Morikawa et al.
6,202,013 B1 3/2001 Anderson et al.
6,328,173 B1 12/2001 Winner
6,634,172 B2 10/2003 Schoonmaker et al.
6,883,532 B2 * 4/2005 Rau ..... B66C 13/066 137/1
7,143,682 B2 12/2006 Nissing et al.
7,269,947 B2 * 9/2007 Yoshino ..... F15B 11/006 60/469
7,278,262 B2 * 10/2007 Moon ..... E02F 9/2207 60/426
7,296,404 B2 11/2007 Pfaff
7,729,832 B2 6/2010 Benckert et al.
7,845,169 B2 12/2010 Brickner et al.
8,037,682 B2 10/2011 Yi et al.
8,082,083 B2 12/2011 Pirr et al.
8,295,310 B2 10/2012 Fourcand
8,925,310 B2 * 1/2015 Pirri ..... E04G 21/0418 60/469
9,810,242 B2 * 11/2017 Wang ..... F15B 21/008
9,933,328 B2 4/2018 Rannow
10,036,407 B2 7/2018 Rannow
10,316,929 B2 * 6/2019 Wang ..... F16F 15/023
10,323,663 B2 * 6/2019 Wang ..... F15B 19/005
10,344,783 B2 7/2019 Wang et al.
10,502,239 B2 12/2019 Wang et al.
10,605,277 B2 3/2020 Wang et al.
10,724,552 B2 7/2020 Rannow et al.
11,028,861 B2 6/2021 Wang
11,047,406 B2 6/2021 Wang et al.
2002/0092417 A1 7/2002 Suzuki et al.
2003/0159576 A1 8/2003 Schoonmaker et al.
2006/0272325 A1 12/2006 Moon
2007/0299589 A1 12/2007 Gianoglio et al.
2008/0034957 A1 2/2008 Stephenson et al.
2008/0087163 A1 4/2008 Brickner et al.
2010/0095835 A1 4/2010 Yuan et al.
2010/0186401 A1 7/2010 Kauss et al.
2011/0088785 A1 4/2011 Balasubramania
2011/0179783 A1 7/2011 Pini et al.
2012/0198832 A1 8/2012 Fukumoto
2014/0026548 A1 1/2014 Vigholm et al.
2014/0150416 A1 6/2014 Lee
2016/0108936 A1 4/2016 Wang
2016/0222989 A1 8/2016 Rannow et al.
2016/0298660 A1 10/2016 Wang et al.
2016/0298719 A1 10/2016 Wang et al.
2017/0204886 A1 7/2017 Wang et al.
2018/0156243 A1 6/2018 Wang
2019/0101137 A1 4/2019 Rannow et al.
2020/0003239 A1 1/2020 Wang et al.
2020/0032820 A1 1/2020 Wang et al.
2020/0124061 A1 * 4/2020 Yuan ..... E04G 21/0436
2020/0124062 A1 * 4/2020 Yuan ..... F15B 13/01
2020/0248720 A1 8/2020 Wang et al.
2021/0010490 A1 1/2021 Rannow et al.

FOREIGN PATENT DOCUMENTS

CN 20 2009 007 668 10/2009
CN 201670158 12/2010
CN 102134909 7/2011
CN 202322251 7/2012
CN 102691683 9/2012
CN 102705288 10/2012
CN 105593438 5/2016
EP 0 457 913 11/1991
EP 1 134 431 5/2005
EP 2 347 988 7/2011
EP 2 503 161 9/2012
EP 3 004 470 4/2016
EP 3 039 301 7/2016
JP H05-1 63746 6/1993
JP 6-147259 5/1994
JP 7-113436 5/1995
JP 7-300881 11/1995
JP 9-041428 2/1997
JP 3079498 8/2000
JP 200320197 1/2003
JP 2004301214 10/2004
JP 2004308746 11/2004
JP 2006300280 11/2006
JP 200974692 4/2009
JP 2012197937 10/2012
JP 201335527 2/2013
KR 10-2003-0088425 A 11/2003
KR 10-1190553 10/2012
WO 2004/088144 10/2004
WO 2014/165888 A1 10/2014
WO 2014/193649 A1 12/2014
WO 2014193649 12/2014
WO 2015/031821 A1 3/2015
WO 2015031821 3/2015
WO 2015/073329 A1 5/2015
WO 2015/073330 A1 5/2015
WO 2015073329 5/2015
WO 2015073330 5/2015
WO 2015191661 12/2015
WO 2016/011193 A1 1/2016
WO 2016011193 1/2016

OTHER PUBLICATIONS

European Search Report and Written Opinion corresponding to 18792266.1.
Extended European Search Report for Application No. 14803575.1 dated Dec. 20, 2016.
Extended European Search Report for corresponding European Patent Application No. 14840792.7 dated May 9, 2017, 5 pages.
Extended European Search Report for Application No. 14862808.4 dated May 17, 2017.
Extended European Search Report for Application No. 14861695.6 dated Jun. 23, 2017.
Extended European Search Report for corresponding European Patent Application No. 15822402.2 dated Mar. 6, 2018, 8 pages.
Honma, K. et al., "Vibration Damping Control for Construction Machinery with a Long Arm Manipulator," Journal of the Robotics Society of Japan (JRSJ), vol. 6, No. 5, pp. 99-102 (Oct. 1988).
International Search Report for corresponding International Patent Application No. PCT/US2014/037879 dated Sep. 22, 2014.

(56) References Cited

OTHER PUBLICATIONS

International Search Report for corresponding International Patent Application No. PCT/US2014/053523 dated Dec. 3, 2014.
International Search Report for corresponding International Patent Application No. PCT/US2014/064646 dated Mar. 12, 2015.
International Search Report for corresponding International Patent Application No. PCT/US2014/064651 dated Feb. 16, 2015.
International Search Report for corresponding International Patent Application No. PCT/US2014/040636 dated Oct. 15, 2015.
International Search Report and Written Opinion of the International Searching Authority for corresponding International Patent Application No. PCT/US2014/040636 dated Oct. 15, 2015, 8 pgs.
Ultronics ZTS16 Conlrol Architecture Overview, Version 1.3,18 pages (Jul. 2010).
Ultronics ZTS16 User Manual V1.0 (for SW Version 2.3 & OD Version 2.2, 52 pages (Nov. 25, 2009).
Extended European Search Report for Application No. 17891854.5 dated Jan. 14, 2021.
International Search Report and Written Opinion of the International Searching Authority for International Patent Application No. PCT/US2018/029384 dated Aug. 9, 2018, 15 pages.

* cited by examiner

SYSTEM FOR DAMPING MASS-INDUCED VIBRATION IN MACHINES HAVING HYDRAULICALLY CONTROLLED BOOMS OR ELONGATE MEMBERS

CROSS-REFERENCE TO RELATED APPLICATIONS

This application is a Continuation of PCT/US2018/029401, filed on Apr. 25, 208, which claims the benefit of U.S. Patent Application Ser. No. 62/491,903, filed on Apr. 28, 2017, and claims the benefit of U.S. Patent Application Ser. No. 62/532,764, filed on Jul. 14, 2017, the disclosures of which are incorporated herein by reference in their entireties.

FIELD OF THE INVENTION

The present invention relates generally to the field of hydraulic systems and, more particularly, to systems for damping mass-induced vibration in machines.

BACKGROUND

Many of today's mobile and stationary machines include long booms or elongate members that may be extended, telescoped, raised, lowered, rotated, or otherwise moved through the operation of hydraulic systems. Examples of such machines include, but are not limited to: concrete pump trucks having articulated multi-segment booms; fire ladder trucks having extendable or telescoping multi-section ladders; fire snorkel trucks having aerial platforms attached at the ends of articulated multi-segment booms; utility company trucks having aerial work platforms connected to extendable and/or articulated multi-segment booms; and, cranes having elongate booms or extendable multi-segment booms. The hydraulic systems generally comprise a hydraulic pump, one or more linear or rotary hydraulic actuators, and a hydraulic control system including hydraulic control valves to control the flow of hydraulic fluid to and from the hydraulic actuators.

The long booms and elongate members of such machines are, typically, manufactured from high-strength materials such as steel, but often flex somewhat due at least in part to their length and being mounted in a cantilever manner. In addition, the long booms and elongate members have mass and may enter undesirable, mass-induced vibration modes in response to movement during use or external disturbances such as wind or applied loads. Various hydraulic compliance methods have been used in attempts to damp or eliminate the mass-induced vibration. However, such methods are not very effective unless mechanical compliance is also carefully addressed.

Therefore, there is a need in the industry for a system and methods for damping mass-induced vibration in machines having long booms or elongate members that requires little or no mechanical compliance, and that addresses these and other problems, issues, deficiencies, or shortcomings.

SUMMARY

Broadly described, the present invention comprises a system, including apparatuses and methods, for damping mass-induced vibration in machines having long booms or elongate members in which vibration is introduced in response to movement of such booms or elongate members. In one inventive aspect, a plurality of control valve spools are operable to supply hydraulic fluid respectively to a non-loading chamber and load holding chamber of an actuator connected to a boom or elongate member, with a first control valve spool being operable in a pressure control mode and a second control valve spool being operable in a flow control mode. In another inventive aspect, a plurality of pressure sensors are operable to measure the pressure of hydraulic fluid in a non-load holding chamber and in a load holding chamber of a hydraulic actuator, and with a processing unit, to control the flow of hydraulic fluid to the load holding chamber to damp mass-induced vibration based at least in part on fluctuations in the measured pressure of the hydraulic fluid in the load holding chamber. In still another inventive aspect, a control manifold is fluidically interposed between a hydraulic actuator and a plurality of control valve spools to cause a first control valve spool to operate in a pressure control mode and a second control valve spool to operate in a flow control mode. In yet another inventive aspect, a control manifold comprises a first part associated with a non-load holding chamber of a hydraulic actuator and a second part associated with a load holding chamber of the hydraulic actuator.

Other inventive aspects, advantages and benefits of the present invention may become apparent upon reading and understanding the present specification when taken in conjunction with the appended drawings.

DETAILED DESCRIPTION OF AN EXAMPLE EMBODIMENT

Figure 1:
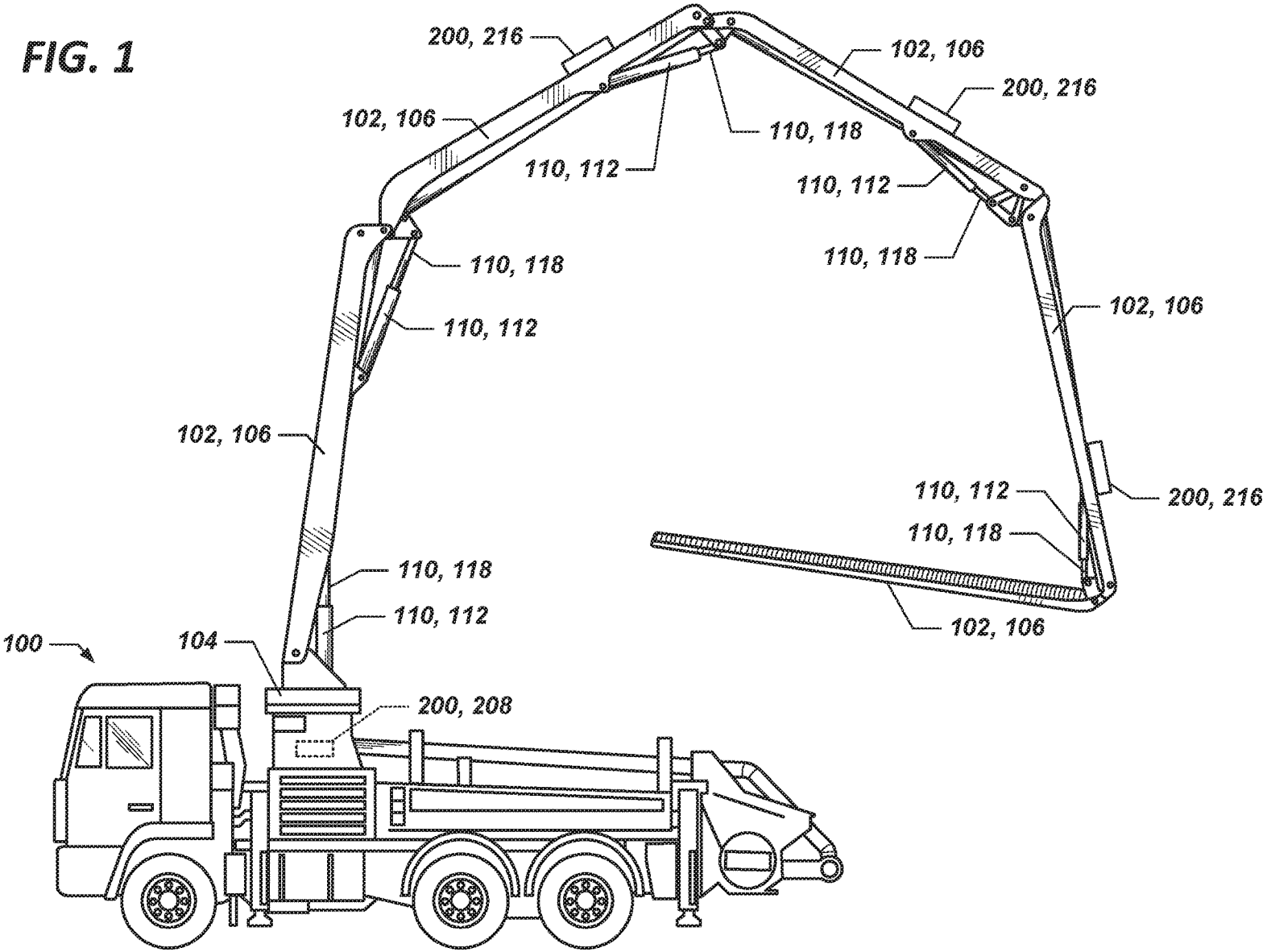
FIG. 1 displays a pictorial view of a mobile machine in the form of concrete pump truck configured with a system for damping mass-induced vibration in accordance with an example embodiment of the present invention.

Referring now to the drawings in which like elements are identified by like numerals throughout the several views, FIG. 1 displays a machine 100 configured with a system for damping mass-induced vibrations 200, including apparatuses and methods, in accordance with the present invention. More specifically, in FIG. 1, the machine 100 comprises a concrete pump truck having an articulated, multi-segment boom 102 that is connected to the remainder of the concrete pump truck by a skewing mechanism 104 that enables rotation of the boom 102 about a vertical axis relative to the remainder of the concrete pump truck. The boom 102 comprises a plurality of elongate boom segments 106 that are pivotally connected by pivot pins 108 in an end-to-end manner. The machine 100 also comprises a plurality of hydraulic actuators 110 that are attached to and between each pair of pivotally connected boom segments 106. The hydraulic actuators 110 generally comprise linear hydraulic actuators operable to extend and contract, thereby causing respective pairs of pivotally connected boom segments 106 to rotate relative to one another about the pivot pin 108 coupling the boom segments 106 together. Each hydraulic actuator 110 has a cylinder 112 and a piston 114 located within the cylinder 112 (see FIGS. 1 and 3). The piston 114 slides within the cylinder 112 and, with the cylinder 112, defines a plurality of chambers 116 for receiving pressurized hydraulic fluid. A rod 118 attached to the piston 114 extends through one the chambers 116, through a wall of the cylinder 112, and is connected to a boom segment 106 to exert forces on the boom segment 106 causing movement of the boom segment 106. A first chamber 116*a* (also sometimes referred to herein as the "non-load holding chamber 116*a*") of the plurality of chambers 116 is located on the rod side of the actuator's piston 114 and a second chamber 116*b* (also sometimes referred to herein as the "load holding chamber 116*b*") of the plurality of chambers 116 is located on the opposite side of the actuator's piston 114. When the entire boom 102 is rotated by the skewing mechanism 104 or when connected boom segments 106 rotated relative to one another about a respective pivot pin 108, vibration is induced in the boom 102 and boom segments 106 because the boom 102 and its boom segments 106 have mass and are being moved relative to the remainder of concrete pump truck or relative to one another.

Before proceeding further, it should be noted that while the system for damping mass-induced vibration 200 is illustrated and described herein with reference to a machine 100 comprising a concrete pump truck having an articulated, multi-segment boom 102, the system for damping mass-induced vibration 200 may be applied to and used in connection with any machine 100 having long booms, elongate members, or other components the movement of which may induce vibration therein. It should also be noted that the system for damping mass-induced vibration 200 may be applied to and used in connection with mobile or stationary machines having long booms, elongate members, or other components in which mass-induced vibration may be introduced by their movement. Additionally, as used herein, the term "hydraulic system" means and includes any system commonly referred to as a hydraulic or pneumatic system, while the term "hydraulic fluid" means and includes any incompressible or compressible fluid that may be used as a working fluid in such a hydraulic or pneumatic system.

Figure 2:
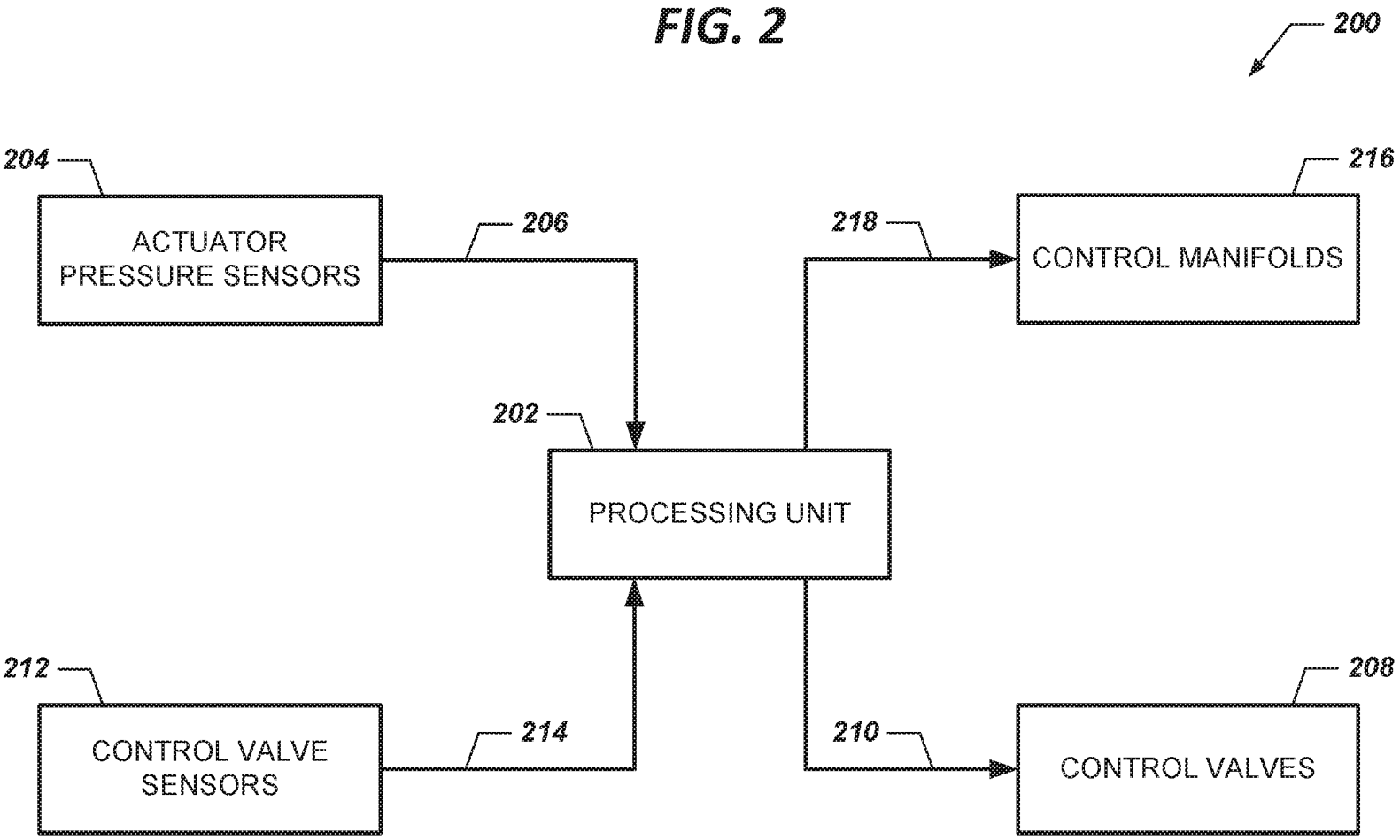
FIG. 2 displays a block diagram representation of the system for damping mass-induced vibration in accordance with the example embodiment of the present invention.

The system for damping mass-induced vibration 200 (also sometimes referred to herein as the "system 200") is illustrated in block diagram form in the block diagram representation of FIG. 2. The system 200 operates on the basis that mass-induced vibration causes fluctuations or perturbations in the pressures of the hydraulic fluid in the load holding and non-load holding chambers 116*a*, 116*b* of a hydraulic actuator 110 and, hence, that by controlling the flow of hydraulic fluid to the chambers 116*a*, 116*b* based at least in part on pressure fluctuations or perturbations, the mass-induced vibration can be dampened. The system 200 comprises a processing unit 202 operable to execute a plurality of software instructions that, when executed by the processing unit 202, cause the system 200 to implement the system's methods and otherwise operate and have functionality as described herein. The processing unit 202 may comprise a device commonly referred to as a microprocessor, central processing unit (CPU), digital signal processor (DSP), or other similar device and may be embodied as a standalone unit or as a device shared with components of the hydraulic system with which the system 200 is employed. The processing unit 202 may include memory for storing the software instructions or the system 200 may further comprise a separate memory device for storing the software instructions that is electrically connected to the processing unit 202 for the bi-directional communication of the instructions, data, and signals therebetween.

The system for damping mass-induced vibration 200 also comprises a plurality of actuator pressure sensors 204 that are connected to the hydraulic actuators 110. The actuator pressure sensors 204 are arranged in pairs such that a pair of actuator pressure sensors 204 is connected to each hydraulic actuator 110 with the actuator pressure sensors 204 of the pair respectively measuring the hydraulic fluid pressure in the non-load holding and load holding chambers 116*a*, 116*b* on opposite sides of the actuator's piston 114. The hydraulic fluid pressures are directly correlated to mass-induced vibration and, hence, their measures and changes in their measures are indicative of the amplitude of and changes in the level of mass-induced vibration. The actuator pressure sensors 204 are operable to produce and output an electrical signal or data representative of the measured hydraulic fluid pressures. The actuator pressure sensors 204 are connected to processing unit 202 via communication links 206 for the communication of signals or data corresponding to the measured hydraulic fluid pressures. Communication links 206 may communicate the signals or data representative of the measured hydraulic fluid pressures to the processing unit 202 using wired or wireless components.

Additionally, the system for damping mass-induced vibration 200 comprises a plurality of control valves 208 that are operable to control pressure and the flow of pressurized hydraulic fluid to respective control manifolds 216 (described below) and, hence, to the respective hydraulic actuators 110 serviced by control manifolds 216 in order to cause the hydraulic actuators 110 to expand or contract. According to an example embodiment, the control valves 208 comprise solenoid-actuated, twin-spool metering control valves and the hydraulic actuators 110 comprise double-acting hydraulic actuators. The control valves 208 each have at least two independently-controllable valve spools 209*a*, 209*b* (also sometimes referred to herein as "spools 209*a*, 209*b*") such that each control valve 208 is operable to perform two independent functions simultaneously with respect to a hydraulic actuator 110, including, without limitation, pressure control for the non-holding camber 116*a* of the hydraulic actuator 110 and damping flow control for the load holding chamber 116*b* of the hydraulic actuator 110. To enable such operation, the spools 209*a*, 209*b* are arranged with one spool 209*a* of a control valve 208 being associated and operable with the non-load holding chamber 116*a* of the hydraulic actuator 110 and the other spool 209*b* of the control valve 208 being associated and operable with the load holding chamber 116*b* of the hydraulic actuator 110. The operation of each spool 209 is independently controlled by processing unit 202 with each control valve 208 and spool 209 being electrically connected to processing unit 202 by a communication link 210 for receiving control signals from the processing unit 202 causing the spools' solenoids to energize or de-energize, thereby correspondingly moving the spools 209 between open, closed and intermediate positions.

While the system 200 is described herein with each control valve 208 comprising a solenoid-actuated, twin-spool metering control valve having two independently-controllable spools 209*a*, 209*b*, it should, however, be appreciated and understood that control valves 208 may comprise other forms of control valves 208 in other example embodiments that are operable to simultaneously and independently provide, in response to receiving control signals from processing unit 202, pressure control for the non-load holding chamber 116*a* of a hydraulic actuator 110 and damping flow control for the load holding chamber 116*b* of the hydraulic actuator 110. It should also be appreciated and understood that control valves 208 may comprise respective embedded controllers that are operable to communicate with processing unit 202 and to operate with processing unit 202 in achieving the functionality described herein.

In addition, the system for damping mass-induced vibration 200 comprises a plurality of control valve sensors 212 that measure various parameters that are related to and indicative of the operation of respective control valves 208. Such parameters include, but are not limited to, hydraulic fluid supply pressure ($P_s$), hydraulic fluid tank pressure ($P_t$), hydraulic fluid delivery pressure ($P_a$, $P_b$), and control valve spool displacement ($x_a$, $x_b$), where subscripts "a" and "b" correspond to actuator chambers 116*a*, 116*b* and to the first and second control valve spools 209*a*, 209*b* of a control valve 208 configured to operate as described below. The control valve sensors 212 are generally attached to or at locations near respective control valves 208 as appropriate to obtain measurements of the above-identified parameters. The control valve sensors 212 are operable to obtain such measurements and to produce and output signals representative of such measurements. Communication links 214 connect the control valve sensors 212 to processing unit 202 for the communication of such output signals to processing unit 202, and may utilize wired and/or wireless communication devices and methods for such communication.

According to an example embodiment, the control valves 208, control valve sensors 212, and processing unit 202 are co-located in a single, integral unit. However, it should be appreciated and understood that, in other example embodiments, the control valves 208, control valve sensors 212, and processing unit 202 may be located in multiple units and in different locations. It should also be appreciated and understood that, in other example embodiments, the control valves 208 may comprise independent metering valves not a part of the system 200.

As illustrated in FIGS. 1 and 2, the system for damping mass-induced vibration 200 further comprises a plurality of control manifolds 216 that are fluidically located between the control valves 208 and the hydraulic actuators 110. Generally, a control manifold 216 and a hydraulic actuator 110 are associated in one-to-one correspondence such that the control manifold 216 participates in controlling the flow of pressurized hydraulic fluid delivered from a control valve spool 209*a*, 209*b* to a chamber 116*a*, 116*b* of the hydraulic actuator 110. The control manifold 216 associated with a particular hydraulic actuator 110 is, typically, mounted near the hydraulic actuator 110 (see FIG. 1). Each control manifold 216 is communicatively connected to processing unit 202 via a communication link 218 for receiving signals from processing unit 202 that control operation of the various components of the control manifold 216 according to the methods described herein. The communication links 218 may comprise wired and/or wireless communication links 218 in different example embodiments.

Figure 3:
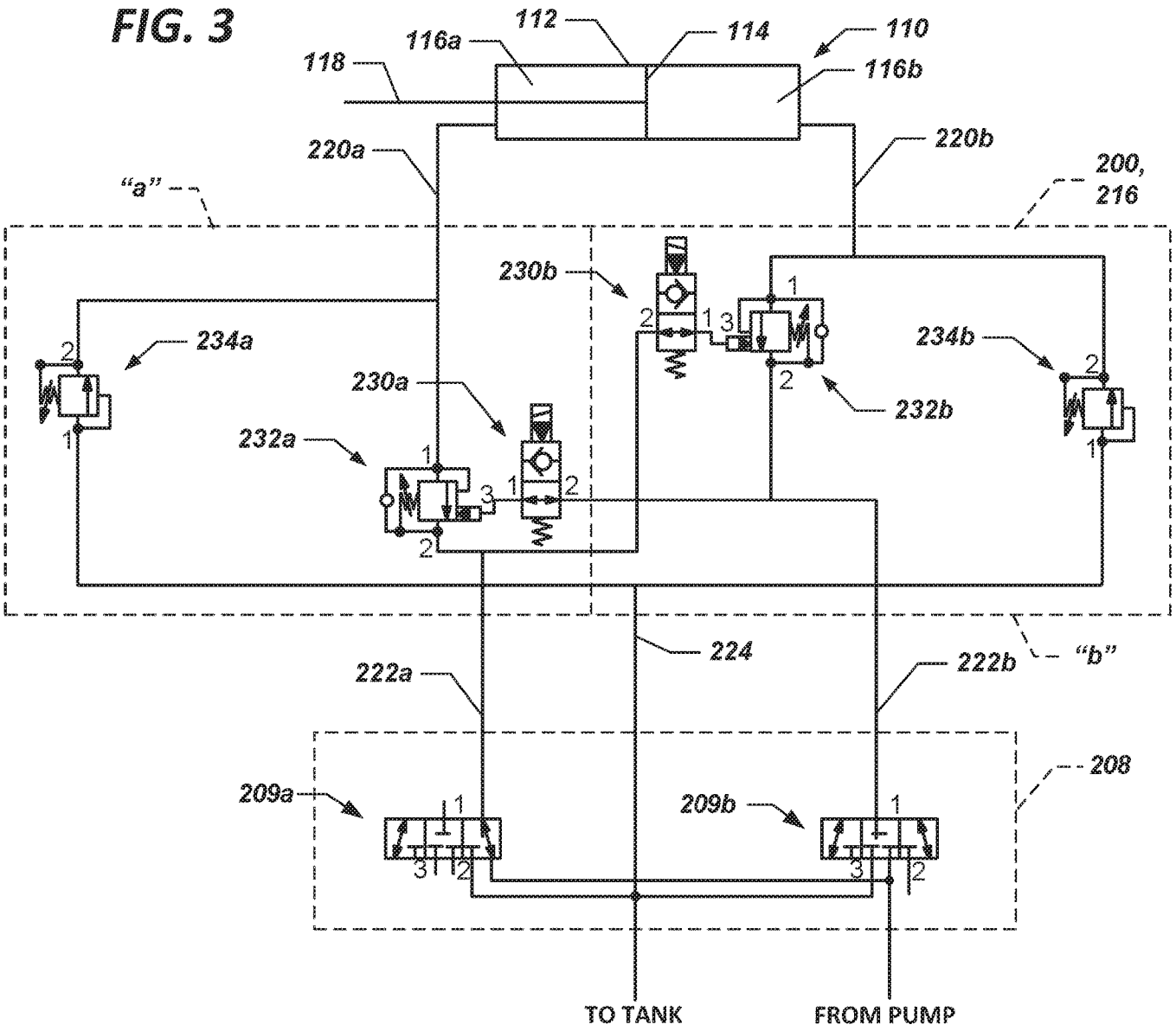
FIG. 3 displays a schematic view of a control manifold of the system for damping mass-induced vibration of FIG. 2.

FIG. 3 displays a schematic view of a control manifold 216, in accordance with an example embodiment, fluidically connected for the flow of hydraulic fluid between a hydraulic actuator 110 and independently-controlled, control valve spools 209*a*, 209*b* of a control valve 208. More particularly, the control manifold 216 is connected to the non-load holding chamber 116*a* of hydraulic cylinder 110 for the flow of hydraulic fluid therebetween by hose 220*a*, and is connected to the load holding chamber 116*b* of hydraulic cylinder 110 for the flow of hydraulic fluid therebetween by a hose 220*b*. Additionally, the control manifold 216 is connected to control valve 208 and valve spool 209*a* for the flow of hydraulic fluid therebetween by hose 222*a*, and is connected to control valve 208 and valve spool 209*b* for the flow of hydraulic fluid therebetween by hose 222*b*. In addition, the control manifold 216 is fluidically connected to a hydraulic fluid tank or reservoir (not shown) by a hose 224 for the flow of hydraulic fluid from the control manifold 216 to the hydraulic fluid tank. It should be appreciated and understood that although hoses 220, 222, 224 are used to connect the control manifold 216 respectively to hydraulic cylinder 110, control valve 208, and a hydraulic fluid tank or reservoir in the example embodiment described herein, the hoses 220, 222, 224 may be replaced in other example embodiments by tubes, conduits, or other apparatuses suitable for conveying hydraulic fluid.

The control manifold 216 comprises isolation valves 230*a*, 230*b*, counterbalance valves 232*a*, 232*b*, and pressure relief valves 234*a*, 234*b* that are arranged in manifold sides "a" and "b" and that are associated and operable, respectively, with the hydraulic actuator's non-load holding chamber 116*a* and load holding chamber 116*b*. As seen in FIG. 3, isolation valve 230*a* is fluidically connected between the pilot port of counterbalance valve 232*a* and the work port of control valve 208 for valve spool 209*b*. The input port of valve spool 209*b* of control valve 208 is fluidically connected to a pump, reservoir, or other source of appropriately pressurized hydraulic fluid. Counterbalance valve 232*a* is fluidically connected between the work port of control valve 208 for valve spool 209*a* and chamber 116*a* of the hydraulic actuator 110. In addition to being fluidically connected to chamber 116*a*, the output port of counterbalance valve 232*a* is fluidically connected to the input port of pressure relief valve 234*a*. The output port of pressure relief valve 234*a* is fluidically connected to a receiving tank or reservoir such that if the pressure of the hydraulic fluid being delivered from counterbalance valve 232*a* to actuator chamber 116*a* has a measure greater than a threshold value, the pressure relief valve 234*a* opens from its normally closed configuration to direct hydraulic fluid to the receiving tank or reservoir.

Similarly, isolation valve 230*b* is fluidically connected between the pilot port of counterbalance valve 232*b* and the work port for valve spool 209*a* of control valve 208. The input port of valve spool 209*a* of control valve 208 is fluidically connected to a pump, reservoir, or other source of appropriately pressurized hydraulic fluid. Counterbalance valve 232*b* is fluidically connected between the work port of valve spool 209*b* of control valve 208 and chamber 116*b* of the hydraulic actuator 110. In addition to being fluidically connected to chamber 116*b*, the output port of counterbalance valve 232*b* is fluidically connected to the input port of pressure relief valve 234*b*. The output port of pressure relief valve 234*b* is fluidically connected to a receiving tank or reservoir such that if the pressure of the hydraulic fluid being delivered from counterbalance valve 232*b* to actuator chamber 116*b* has a measure greater than a threshold value, the pressure relief valve 234*b* opens from its normally closed configuration to direct hydraulic fluid to the receiving tank or reservoir.

The counterbalance valves 232*a*, 232*b*, according to an example embodiment, have a high pressure ratio and are capable of being opened with a relatively low pilot pressure. The pilot pressure to counterbalance valves 232*a*, 232*b* is controlled, respectively, by isolation valves 230*a*, 230*b* together with valve spools 209*a*, 209*b* of control valve 208. By default, electric current is not supplied to the isolation valves 230*a*, 230*b* and the isolation valves 230*a*, 230*b* allow hydraulic fluid to flow therethrough. The valve spools 209 of control valves 208 are operable in pressure control, flow control, spool position control, and in various other modes.

Figure 4:
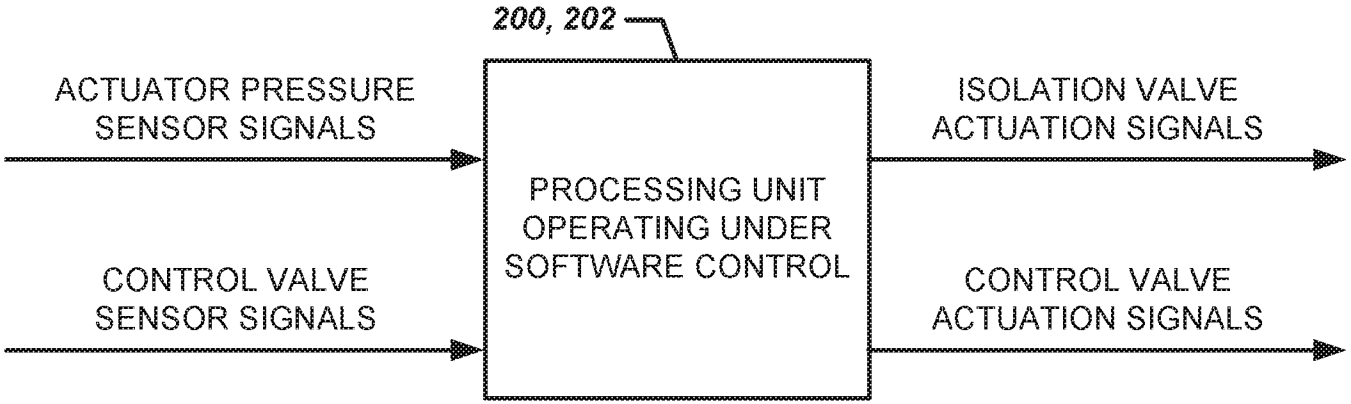
FIG. 4 displays a control diagram representation of the control methodology used by the system for damping mass-induced vibration.

During operation of the system for damping mass-induced vibration 200 and as illustrated in control diagram of FIG. 4, the actuator pressure sensors 204 produce electrical signals or data representative of the pressure of the hydraulic fluid present in actuator chambers 116*a*, 116*b*. Also, the control valve sensors 212 produce electrical signals or data representative of the hydraulic fluid supply pressure ($P_s$) to control valves 208, hydraulic fluid tank pressure ($P_t$), hydraulic fluid delivery pressure ($P_a$, $P_b$) at the work ports of control valves 208, and the spool displacement ($x_a$, $x_b$) of the spools 209*a*, 209*b* of control valves 208. The processing unit 202 receives the signals or data from actuator pressure sensors 204 and control valve sensors 212 via communication links 206, 214. Operating under the control of stored software instructions and based on the received input signals or data, the processing unit 202 generates output signals or data for delivery to the isolation valves 230*a*, 230*b* and valve spools 209*a*, 209*b* of control valves 208 via communication links 218, 210, respectively. More particularly, the processing unit 202 produces separate actuation signals or data to cause the turning on or off of isolation valves 230*a*, 230*b* and to adjust the operation of valve spools 209*a*, 209*b* of control valves 208 in accordance with the methods described herein.

Figure 5:
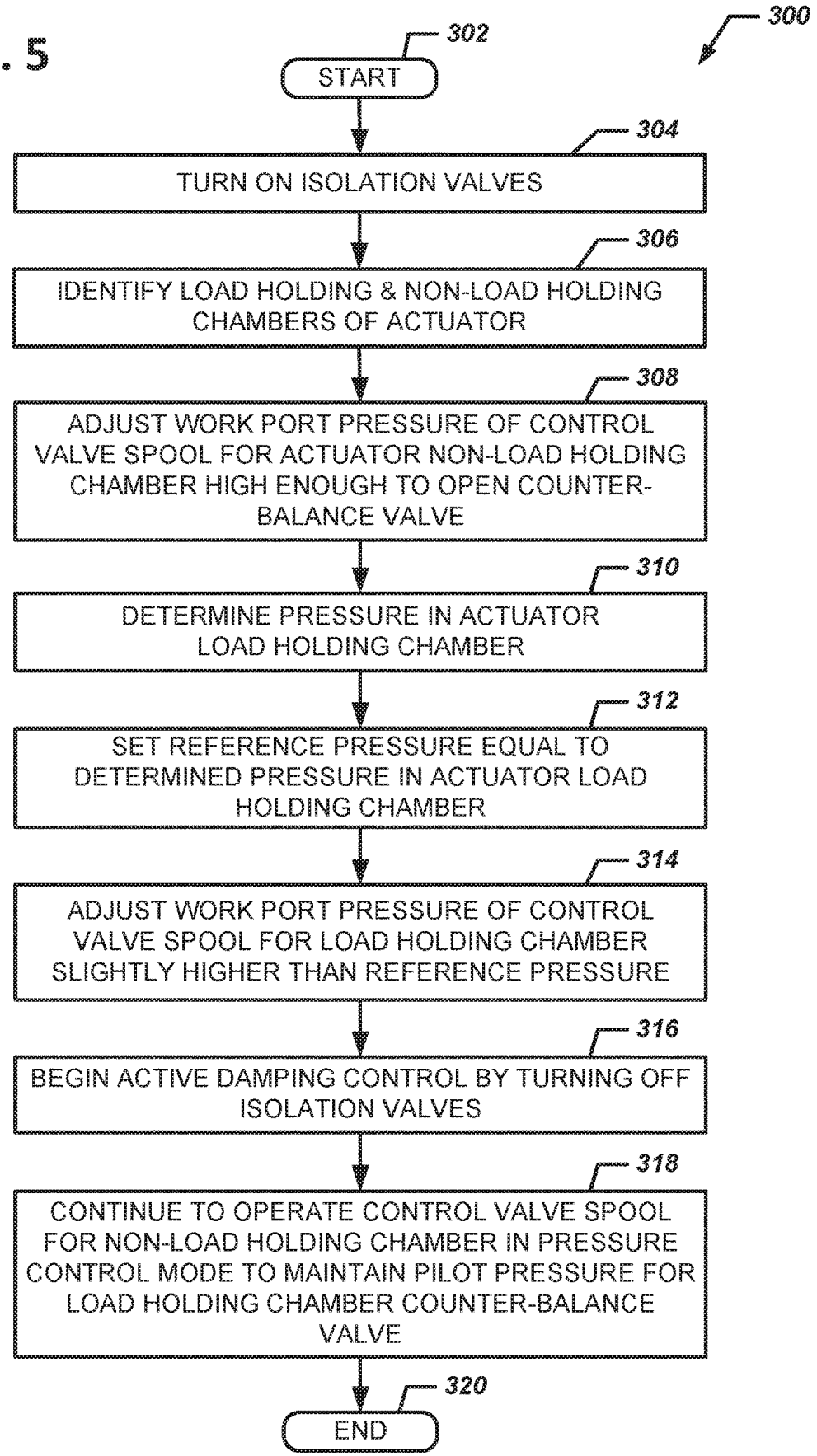
FIG. 5 displays a flowchart representation of a method for damping mass-induced vibration in accordance with the example embodiment of the present invention.

The system 200 operates in accordance with a method 300 illustrated in FIG. 5 to damp mass-induced vibration. Operation according to method 300 starts at step 302 and proceeds to step 304 where the isolation valves 230 are initialized to an "on" state by the processing unit 202 generating respective isolation valve actuation signals that cause electrical current to be supplied to the isolation valves 230. In such "on" state, the isolation valves 230 stop the flow of hydraulic fluid to the pilot port of respective counterbalance valves 232, causing the counterbalance valves 232 to be closed to the flow of hydraulic fluid therethrough. Next, at step 306, the processing unit 202 identifies the non-load holding and load holding chambers 116*a*, 116*b* of hydraulic actuator 110 based on the pressures measured for each actuator chamber 116. To do so, the processing unit 202 uses the actuator pressure signals received from the actuator pressure sensors 204 for each chamber 116 and the known dimensions and area of the piston 114 and rod 118.

Continuing at step 308 of method 300, the work port pressure ($P_a$) for valve spool 209*a* associated with non-load holding chamber 116*a* is adjusted to be high enough to open counterbalance valve 232*b*. The adjustment is made by the processing unit 202 generating and outputting appropriate signals or data to valve spool 209*a* and control valve 208 via a communication link 210. According to an example embodiment, such work port pressure may be approximately 20 bar. Then, at step 310, the processing unit 202 determines the pressure present in the actuator's load holding chamber 116*b* by using actuator pressure signals received from the actuator pressure sensor 204 for chamber 116*b* and the known dimensions and area of the piston 114. Subsequently, at step 312, the processing unit 202 sets a reference pressure equal to the determined pressure of the hydraulic fluid in the load holding chamber 116*b*. The processing unit 202 then, at step 314, causes adjustment of the work port pressure ($P_b$) of the load holding chamber 116*b* to be slightly higher than the reference pressure. To do so, the processing unit 202 generates and outputs appropriate signals or data to valve spool 209*b* of control valve 208 via a communication link 210.

At step 316 and after hydraulic fluid pressures stabilize, active damping control is begun by setting the isolation valves 230*a*, 230*b* to an "off" state. The processing unit 202 sets the isolation valves 230*a*, 230*b* in the "off" state by generating and outputting a signal or data on respective communication links 218 that is appropriate to cause no electrical current to be supplied to the isolation valves 230*a*, 230*b*. In such "off" state, hydraulic fluid flows through the isolation valves 230*a*, 230*b* and to the pilot ports of the respective counterbalance valves 232*a*, 232*b*, resulting in the counterbalance valves 232*a*, 232*b* opening for the flow of hydraulic fluid therethrough because the controlled pressures are high enough to maintain the counterbalance valves 232*a*, 232*b* open. Next, at step 318, valve spool 209*a* of control valve 208 continues to operate in pressure control mode to build sufficient pilot pressure for counterbalance valve 232*b*, and valve spool 209*b* of control valve 208 operates in flow control mode. In flow control mode, the flow rate of hydraulic fluid from valve spool 209*b* of control valve 208 is directly related to the hydraulic fluid pressure and is given by:

$$Q_b(t)=-kP_b$$

where: k is the gain for pressure-based flow control;

$P_b$ is the perturbation of the work port pressure around a mean value.

The perturbation of the work port pressure should be associated with the key vibration mode. Therefore, it may be necessary to filter the pressure signals using one or more band pass filters to remove the mean value not associated with the key vibration mode. With valve spool 209*a* of control valve 208 operating in pressure control mode and valve spool 209*b* of control valve 208 operating in flow control mode, the method 300 ends at step 320.

Whereas the present invention has been described in detail above with respect to an example embodiment thereof, it should be appreciated that variations and modifications might be effected within the spirit and scope of the present invention.

EXAMPLES

Illustrative examples of the apparatus disclosed herein are provided below. An example of the apparatus may include any one or more, and any combination of, the examples described below.

Example 1

In combination with, or independent thereof, any example disclosed herein, an apparatus for damping mass-induced vibration in a machine including an elongate member and a hydraulic actuator configured to move the elongate member and having a non-load holding chamber and a load holding chamber, the apparatus including a plurality of pressure sensors that are operable to measure the pressures of hydraulic fluid in the non-load holding chamber and the load holding chamber of the hydraulic actuator. The apparatus includes a plurality of control valve spools operable to supply variable flow rates of hydraulic fluid to the hydraulic actuator. The apparatus includes a control manifold fluidically interposed between the hydraulic actuator and the plurality of control valve spools. The apparatus includes a processing unit operable with said control manifold to control the flow of hydraulic fluid to the hydraulic actuator based at least in part on the pressure of hydraulic fluid in the load holding chamber of the hydraulic actuator.

Example 2

In combination with, or independent thereof, any example disclosed herein, the processing unit is further operable with said control manifold to control the flow of hydraulic fluid to the hydraulic actuator based at least in part on the pressure of hydraulic fluid in the non-load holding chamber of the hydraulic actuator.

Example 3

In combination with, or independent thereof, any example disclosed herein, the apparatus further includes a plurality of control valve sensors operable to measure the pressure of hydraulic fluid exiting the control valve spools, and the control manifold is further operable to control the flow of hydraulic fluid to the hydraulic actuator.

Example 4

In combination with, or independent thereof, any example disclosed herein, the processing unit is further operable to produce signals for adjusting the flow rate of hydraulic fluid from the control valve spools.

Example 5

In combination with, or independent thereof, any example disclosed herein, the apparatus further includes a plurality of control valve sensors operable to determine the displacement of the control valve spools. The processing unit is operable to produce signals for adjusting the flow rate of hydraulic fluid from the control valve spools based at least in part on the displacement.

Example 6

In combination with, or independent thereof, any example disclosed herein, the control manifold includes a first isolation valve operable to deliver pilot hydraulic fluid at a pilot pressure. The control manifold includes a first counterbalance valve fluidically connected to the first isolation valve for receiving pilot hydraulic fluid from said first isolation valve. The first counterbalance valve is fluidically connected to the non-load holding chamber of the hydraulic actuator and is operable to deliver hydraulic fluid to the non-load holding chamber of the hydraulic actuator. The control manifold includes a second isolation valve operable to deliver pilot hydraulic fluid at a pilot pressure. The control manifold includes a second counterbalance valve fluidically connected to the second isolation valve for receiving pilot hydraulic fluid from the second isolation valve. The second counterbalance valve is fluidically connected to the non-load holding chamber of the hydraulic actuator and is operable to deliver hydraulic fluid to the load holding chamber of the hydraulic actuator.

Example 7

In combination with, or independent thereof, any example disclosed herein, the plurality of control valve spools include a first control valve spool fluidically connected to the first counterbalance valve and to the second isolation valve. The first control valve spool is operable to supply hydraulic fluid at a first pressure to the first counterbalance valve and the second isolation valve. The plurality of control valve spools includes a second control valve spool fluidically connected to the second counterbalance valve and to the first isolation valve. The second control valve spool is operable to supply hydraulic fluid at a second pressure to the second counterbalance valve and the first isolation valve.

Example 8

In combination with, or independent thereof, any example disclosed herein, a first control valve spool of the plurality of control valve spools is operable in pressure control mode and a second control valve spool of the plurality of control valve spools is operable in flow control mode.

Example 9

In combination with, or independent thereof, any example disclosed herein, the plurality of control valve spools are operable to simultaneously achieve different functions.

Example 10

In combination with, or independent thereof, any example disclosed herein, a first control valve spool of the plurality of control valve spools is operable with the non-load holding chamber of the hydraulic actuator. A second control valve spool of the plurality of control valve spools is operable with the load holding chamber of the hydraulic actuator.

Example 11

In combination with, or independent thereof, any example disclosed herein, the control valve spools include independently operable control valve spools of a metering valve.

Example 12

In combination with, or independent thereof, any example disclosed herein, an apparatus for damping mass-induced vibration in a machine including an elongate member and a hydraulic actuator configured to move the elongate member, the hydraulic actuator having a non-load holding chamber and a load holding chamber, the apparatus includes a first isolation valve that is operable to deliver pilot hydraulic fluid at a pilot pressure. The apparatus includes a first counterbalance valve fluidically connected to the first isolation valve for receiving pilot hydraulic fluid from the first isolation valve. The first counterbalance valve is fluidically connected to the non-load holding chamber of the hydraulic actuator and is operable to deliver hydraulic fluid to the non-load holding chamber of the hydraulic actuator. The apparatus includes a second isolation valve that is operable to deliver pilot hydraulic fluid at a pilot pressure. The apparatus includes a second counterbalance valve fluidically connected to the second isolation valve for receiving pilot hydraulic fluid from the second isolation valve. The second counterbalance valve is fluidically connected to the non-load holding chamber of the hydraulic actuator and is operable to deliver hydraulic fluid to the load holding chamber of the hydraulic actuator. The apparatus includes a first control valve spool fluidically connected to the first counterbalance valve and to the second isolation valve. The first control valve spool is operable to supply hydraulic fluid at a first pressure to the first counterbalance valve and the second isolation valve. The apparatus includes a second control valve spool fluidically connected to the second counterbalance valve and to the first isolation valve. The second control valve spool is operable to supply hydraulic fluid at a second pressure to the second counterbalance valve and the first isolation valve. The apparatus includes a processing unit operable to generate and output signals causing independent actuation of the first and second isolation valves and independent actuation of the first and second control valve spools, causing the first control valve spool to operate in pressure control mode and the second control valve spool to operate in flow control mode.

Example 13

In combination with, or independent thereof, any example disclosed herein, the first pressure has a measure sufficient for operation of the second counterbalance valve.

Example 14

In combination with, or independent thereof, any example disclosed herein, the second pressure has a measure sufficient for actuation of the hydraulic actuator.

Example 15

In combination with, or independent thereof, any example disclosed herein, the apparatus further includes a pressure sensor operable to measure the pressure of hydraulic fluid in the load holding chamber of the hydraulic actuator. The processing unit is further operable to receive the measured pressure and to generate and output signals controlling the flow of hydraulic fluid to the hydraulic actuator based at least in part on the pressure of hydraulic fluid in the load holding chamber of the hydraulic actuator.

Example 16

In combination with, or independent thereof, any example disclosed herein, the flow rate of hydraulic fluid to the hydraulic actuator is directly related to the measured pressure of hydraulic fluid in the load holding chamber of the hydraulic actuator.

Example 17

In combination with, or independent thereof, any example disclosed herein, the flow rate of hydraulic fluid to the hydraulic actuator is calculated as the mathematical product of the measured pressure of hydraulic fluid in the load holding chamber of the hydraulic actuator and a constant selected based at least on a desired damping rate.

Example 18

In combination with, or independent thereof, any example disclosed herein, the control valve spool is operable independently of the second control valve spool.

Example 19

In combination with, or independent thereof, any example disclosed herein, the first control valve spool is operable in pressure control mode simultaneously while the second control valve spool is operable in flow control mode.

Example 20

In combination with, or independent thereof, any example disclosed herein, the first control valve spool and the second control valve spool comprise control valve spools of a single metering control valve.

What is claimed is:

1. An apparatus for damping mass-induced vibration in a machine including an elongate member and a hydraulic actuator configured to move the elongate member and having a non-load holding chamber and a load holding chamber, said apparatus comprising:

a plurality of pressure sensors operable to measure the pressures of hydraulic fluid in the non-load holding chamber and the load holding chamber of the hydraulic actuator;

a plurality of control valve spools operable to supply variable flow rates of hydraulic fluid to the hydraulic actuator;

a control manifold fluidically interposed between the hydraulic actuator and said plurality of control valve spools; and a processing unit operable with said control manifold to control the flow of hydraulic fluid to the hydraulic actuator based at least in part on controlling one of the plurality of control valve spools to meet a flow demand calculated as a function of a perturbation of pressure measurement around a mean value, the pressure measurement corresponding to the pressure of hydraulic fluid in the load holding chamber of the hydraulic actuator.

2. The apparatus of claim 1, wherein said processing unit is further operable with said control manifold to control the flow of hydraulic fluid to the hydraulic actuator based at least in part on the pressure of hydraulic fluid in the non-load holding chamber of the hydraulic actuator.

3. The apparatus of claim 2, wherein said apparatus further comprises a plurality of control valve sensors operable to measure the pressure of hydraulic fluid exiting said control valve spools, and wherein said control manifold is further operable to control the flow of hydraulic fluid to the hydraulic actuator.

4. The apparatus of claim 1, wherein said processing unit is further operable to produce signals for adjusting the flow rate of hydraulic fluid from said control valve spools.

5. The apparatus of claim 4, wherein said apparatus further comprises a plurality of control valve sensors operable to determine a displacement of said control valve spools, and wherein said processing unit is operable to produce signals for adjusting the flow rate of hydraulic fluid from said control valve spools based at least in part on said displacement.

6. The apparatus of claim 1, wherein said control manifold includes:

a first isolation valve operable to deliver pilot hydraulic fluid at a pilot pressure;

a first counterbalance valve fluidically connected to said first isolation valve for receiving pilot hydraulic fluid from said first isolation valve, said first counterbalance valve being fluidically connected to the non-load holding chamber of the hydraulic actuator and being operable to deliver hydraulic fluid to the non-load holding chamber of the hydraulic actuator;

a second isolation valve operable to deliver pilot hydraulic fluid at a pilot pressure; and a second counterbalance valve fluidically connected to said second isolation valve for receiving pilot hydraulic fluid from said second isolation valve, said second counterbalance valve being fluidically connected to the load holding chamber of the hydraulic actuator and being operable to deliver hydraulic fluid to the load holding chamber of the hydraulic actuator.

7. The apparatus of claim 6, wherein said plurality of control valve spools comprises:

a first control valve spool fluidically connected to said first counterbalance valve and to said second isolation valve, said first control valve spool being operable to supply hydraulic fluid at a first pressure to said first counterbalance valve and said second isolation valve; and a second control valve spool fluidically connected to said second counterbalance valve and to said first isolation valve, said second control valve spool being operable to supply hydraulic fluid at a second pressure to said second counterbalance valve and said first isolation valve.

8. The apparatus of claim 1, wherein a first control valve spool of said plurality of control valve spools is operable in pressure control mode and a second control valve spool of said plurality of control valve spools is operable in flow control mode.

9. The apparatus of claim 1, wherein said plurality of control valve spools are operable to simultaneously achieve different functions.

10. The apparatus of claim 1, wherein a first control valve spool of said plurality of control valve spools is operable with the non-load holding chamber of the hydraulic actuator, and a second control valve spool of said plurality of control valve spools is operable with the load holding chamber of the hydraulic actuator.

11. The apparatus of claim 1, wherein said control valve spools comprise independently operable control valve spools of a metering valve.

12. The apparatus of claim 1, wherein the flow demand is calculated by multiplying the perturbation measurement by a constant gain value.

13. The apparatus of claim 1, wherein the processing unit is operable to filter pressure signals, with one or more band pass filters, to remove mean values not associated with a key vibration mode associated with the perturbation measurement.

14. An apparatus for damping mass-induced vibration in a machine including an elongate member and a hydraulic actuator configured to move the elongate member, the hydraulic actuator having a non-load holding chamber and a load holding chamber, said apparatus comprising:

a first isolation valve operable to deliver pilot hydraulic fluid at a pilot pressure;

a first counterbalance valve fluidically connected to said first isolation valve for receiving pilot hydraulic fluid from said first isolation valve, said first counterbalance valve being fluidically connected to the load holding chamber of the hydraulic actuator and being operable to deliver hydraulic fluid to the non-load holding chamber of the hydraulic actuator;

a second isolation valve operable to deliver pilot hydraulic fluid at a pilot pressure;

a second counterbalance valve fluidically connected to said second isolation valve for receiving pilot hydraulic fluid from said second isolation valve, said second counterbalance valve being fluidically connected to the non-load holding chamber of the hydraulic actuator and being operable to deliver hydraulic fluid to the load holding chamber of the hydraulic actuator;

a first control valve spool fluidically connected to said first counterbalance valve and to said second isolation valve, said first control valve spool being operable to supply hydraulic fluid at a first pressure to said first counterbalance valve and said second isolation valve;

a second control valve spool fluidically connected to said second counterbalance valve and to said first isolation valve, said second control valve spool being operable to supply hydraulic fluid at a second pressure to said second counterbalance valve and said first isolation valve; and a processing unit operable to generate and output signals causing independent actuation of said first and second isolation valves and independent actuation of said first and second control valve spools, and causing said first control valve spool to operate in pressure control mode and said second control valve spool to operate in flow control mode in which a flow control demand is calculated based on perturbations of pressure.

15. The apparatus of claim 14, wherein said first pressure has a measure sufficient for operation of said second counterbalance valve.

16. The apparatus of claim 14, wherein said second pressure has a measure sufficient for actuation of the hydraulic actuator.

17. The apparatus of claim 14, wherein the apparatus further comprises a pressure sensor operable to measure the pressure of hydraulic fluid in the load holding chamber of the hydraulic actuator, and wherein said processing unit is further operable to receive the measured pressure and to generate and output signals controlling the flow of hydraulic fluid to the hydraulic actuator based at least in part on the pressure of hydraulic fluid in the load holding chamber of the hydraulic actuator.

18. The apparatus of claim 17, wherein a flow rate of hydraulic fluid to the hydraulic actuator is directly related to the measured pressure of hydraulic fluid in the load holding chamber of the hydraulic actuator.

19. The apparatus of claim 16, wherein the flow rate of hydraulic fluid to the hydraulic actuator is calculated as a mathematical product of the measured pressure of hydraulic fluid in the load holding chamber of the hydraulic actuator and a constant selected based at least on a desired damping rate.

20. The apparatus of claim 14, wherein said first control valve spool is operable independently of said second control valve spool.

21. The apparatus of claim 14, wherein said first control valve spool is operable in pressure control mode simultaneously while said second control valve spool is operable in flow control mode.

22. The apparatus of claim 14, wherein said first control valve spool and said second control valve spool comprise control valve spools of a single metering control valve.

* * * * *